US009062683B2

(12) United States Patent
Kang

(10) Patent No.: US 9,062,683 B2
(45) Date of Patent: Jun. 23, 2015

(54) WATER PUMP FOR VEHICLE

(75) Inventor: Bongseong Kang, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 309 days.

(21) Appl. No.: 13/547,782

(22) Filed: Jul. 12, 2012

(65) Prior Publication Data

US 2013/0142622 A1 Jun. 6, 2013

(30) Foreign Application Priority Data

Dec. 1, 2011 (KR) ..... 10-2011-0127964

(51) Int. Cl.

| | |
|---|---|
| ***F04D 13/00*** | (2006.01) |
| ***F04D 29/40*** | (2006.01) |
| ***F04D 13/02*** | (2006.01) |
| ***F04D 25/02*** | (2006.01) |

(52) U.S. Cl.

CPC ..... *F04D 13/025* (2013.01); *F04D 25/026* (2013.01); *F04D 29/40* (2013.01); *F04D 13/026* (2013.01); *F04D 13/027* (2013.01)

(58) Field of Classification Search

CPC ... F04D 13/024; F04D 13/025; F04D 13/026; F04D 13/027; F04D 25/026; F04D 29/40

USPC ..... 417/420, 423.12, 423.14, 423.9

See application file for complete search history.

(56) References Cited

U.S. PATENT DOCUMENTS

| | | | | | |
|---|---|---|---|---|---|
| 2,471,753 | A | * | 5/1949 | Johnston | 417/420 |
| 2,996,994 | A | * | 8/1961 | Wright | 417/420 |
| 3,074,347 | A | * | 1/1963 | Clymer | 417/363 |
| 3,172,364 | A | * | 3/1965 | Barotz | 417/420 |
| 3,299,819 | A | * | 1/1967 | McCoy | 417/420 |
| 3,512,901 | A | * | 5/1970 | Law | 417/53 |
| 3,723,029 | A | * | 3/1973 | Laing | 417/420 |
| 4,589,822 | A | * | 5/1986 | Clausen et al. | 415/174.3 |
| 4,645,432 | A | * | 2/1987 | Tata | 417/420 |
| 4,844,707 | A | * | 7/1989 | Kletschka | 417/420 |

FOREIGN PATENT DOCUMENTS

| | | | |
|---|---|---|---|
| JP | 2003-129999 | A | 5/2003 |
| JP | 2006-233966 | A | 9/2006 |
| KR | 1997-0009832 | B | 6/1997 |
| KR | 9709832 | B1 * | 6/1997 |
| KR | 10-2010-0052772 | A | 5/2010 |

* cited by examiner

*Primary Examiner* — Devon Kramer

*Assistant Examiner* — Nathan Zollinger

(74) *Attorney, Agent, or Firm* — Morgan, Lewis & Bockius LLP

(57) ABSTRACT

A water pump for a vehicle may include a water pump housing, a water pump drive shaft, a bearing, a first rotation plate connected to one end of the water pump drive shaft, a first magnet mounted on one surface of the first rotation plate, an impeller rotation shaft coaxially disposed with the water pump drive shaft, an impeller bearing rotatably enclosing an exterior circumference of the impeller rotation shaft, a second rotation plate connected to one end of the impeller bearing, a second magnet mounted on one surface of the second rotation plate, and an impeller connected to the other end of the impeller bearing, wherein the one surface of the first rotation plate and the one surface of the second rotation plate may be disposed apart from and face each other, and facing poles of the first and second magnets may be different from each other.

9 Claims, 1 Drawing Sheet

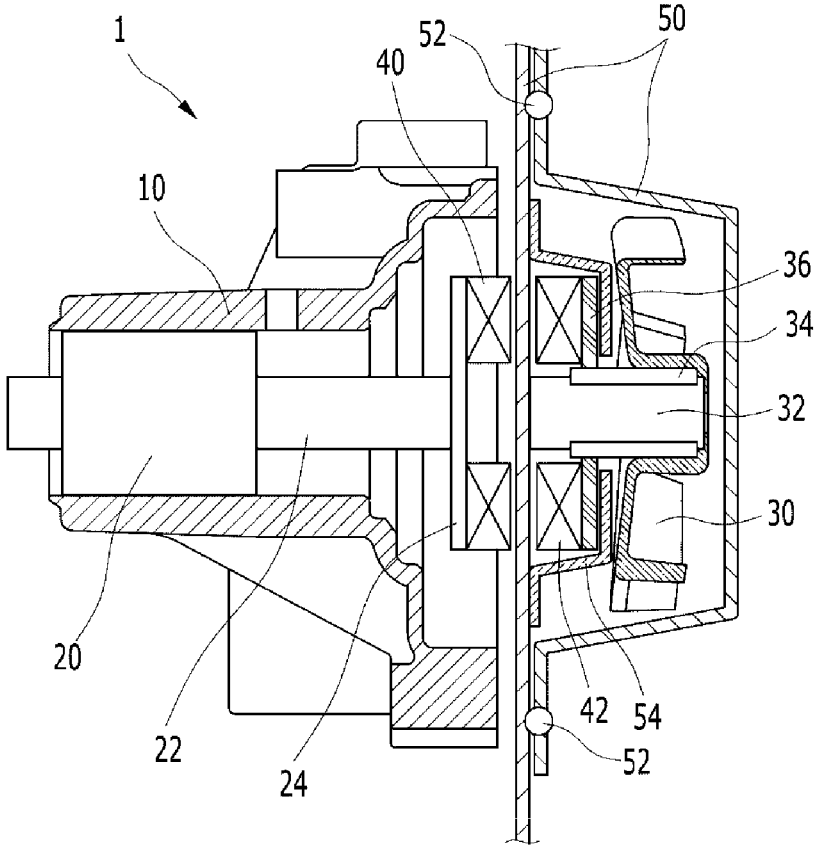
1
52
50
40
10
36
34
32
30
20
22
24
42
54
52

WATER PUMP FOR VEHICLE

CROSS-REFERENCE TO RELATED APPLICATION

The present application claims priority to Korean Patent Application No. 10-2011-0127964 filed in the Korean Intellectual Property Office on Dec. 1, 2011, the entire contents of which is incorporated herein for all purposes by this reference.

BACKGROUND OF THE INVENTION

1. Field of the Invention

The present invention relates to a water pump for a vehicle. More particularly, the present invention relates to a water pump for a vehicle of which performance thereof is improved and leakage of coolant is prevented.

2. Description of Related Art

Generally, a cooling apparatus of a vehicle maintains the temperature of an engine in operation to be constant. In addition, the cooling apparatus is a water-cooled type using coolant or an air-cooled type using exterior air.

The air-cooled type uses a method in which the engine directly contacts the air. The air-cooled type does not need a coolant supplied thereto, thus leakage and freezing of coolant do not occur, and the system is simple. However, uniform cooling of the engine according to an operation condition thereof is difficult and a large amount of noise occurs in the air-cooled type, so this type is not widely used.

The water-cooled type uses coolant for cooling the engine, and is separated into a gravity circulation type and a forced circulation type according to the circulating type of the coolant. The coolant is circulated by convection in the gravity circulation type, and thus the gravity circulation type is not appropriate for a high performance engine.

Meanwhile, the forced circulation type is the typical circulation type currently used for vehicles, and the coolant is circulated by an operation of a water pump in the forced circulation type. In addition, the forced circulation type is most appropriate for high performance engines. That is, the water pump is provided for circulating the coolant in the engine using the water-cooled type.

In addition, the water pump is operated by always being in direct contact with the coolant. Meanwhile, a failure of a bearing may be generated or the lifetime of a belt may be reduced when the coolant leaks from the water pump. Therefore, a sealing member is mounted at a drive shaft of the water pump so as to prevent leakage of coolant. In addition, a drain hole is formed at the water pump housing for preventing coolant in a gaseous state and including particles from passing the sealing member and permeating to the bearing.

However, aesthetic features may be deteriorated if the coolant is exhausted to the outside through the drain hole. In addition, the manufacturing cost of the water pump is increased if a sealing member having a high cost is used for improving sealing performance. Further, cavitation occurs such that noise and vibration is generated since rotation speed of an impeller is not constantly maintained in a conventional water pump. Furthermore, components of the impeller can be damaged by the cavitation.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a water pump for a vehicle having advantages of preventing leakage of coolant.

In addition, performance of a water pump for a vehicle can be improved even though a number of components is decreased.

A water pump for a vehicle may include a water pump housing forming an outer wall of the water pump, a water pump drive shaft mounted in the water housing and rotated by power of driving the water pump, a bearing mounted in the water pump housing and rotatably supporting the water pump drive shaft to slidably rotate the water pump drive shaft in the water pump, a first rotation plate connected to one end of the water pump drive shaft and rotating with the water pump drive shaft, a first magnet mounted on one surface of the first rotation plate, an impeller rotation shaft coaxially disposed with the water pump drive shaft, an impeller bearing rotatably enclosing an exterior circumference of the impeller rotation shaft, a second rotation plate connected to one end of the impeller bearing so as to rotate with the impeller bearing, a second magnet mounted on one surface of the second rotation plate, and an impeller connected to the other end of the impeller bearing so as to rotate with the impeller bearing, wherein the one surface of the first rotation plate and the one surface of the second rotation plate are disposed apart from and face each other, and the first magnet and the second magnet are disposed apart from each other such that facing poles of the first and second magnets are different from each other.

The second rotation plate is rotated by magnetic force of the first magnet and the second magnet when the first rotation plate is rotated.

The water pump may further include an impeller case forming a space therein in which the impeller rotation shaft, the impeller bearing, the second rotation plate, the second magnet and the impeller are disposed, wherein a portion of the impeller case is disposed between the first magnet and the second magnet and the impeller rotation shaft is fixedly connected to the portion of the impeller case.

The impeller case is formed by coupling two pieces, and at least one of the two pieces is bent so as to form the space, wherein an O-ring is disposed between the two pieces, wherein one of the two pieces of the impeller case is disposed between the first magnet and the second magnet and the impeller rotation shaft is fixedly connected to the one of the two pieces.

A dust cover is disposed near the second magnet between the second magnet and the impeller so as to prevent foreign materials from flowing into the second magnet, wherein one end of the dust cover is fixedly connected to the one of the two pieces and the other end of the dust cover extends so as to enclose the second rotation plate and the second magnet.

A distal end of the impeller is aligned toward the dust cover to prevent foreign material from entering into the second magnet, wherein the one of the two pieces is fixedly connected to the water pump housing.

A dust cover is disposed near the second magnet between the second magnet and the impeller so as to prevent foreign materials from flowing into the second magnet, wherein one end of the dust cover is fixedly connected to the impeller case and the other end of the dust cover extends so as to enclose the second rotation plate and the second magnet, and wherein a distal end of the impeller is aligned toward the dust cover to prevent foreign material from entering into the second magnet.

The impeller case is fixedly connected to the water pump housing.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 1 is a schematic diagram of a water pump for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic diagram of a water pump for a vehicle according to an exemplary embodiment of the present invention.

As shown in FIG. 1, a water pump 1 for a vehicle according to an exemplary embodiment of the present invention includes a water pump housing 10, a water pump drive shaft 22, a bearing 20, a first rotation plate 24, an impeller rotation shaft 32, an impeller bearing 34, a second rotation plate 36, an impeller 30, a first magnet 40, a second magnet 42, an impeller case 50, an O-ring 52 and a dust cover 54.

The water pump housing 10 forms an outer wall of the water pump 1.

The water pump drive shaft 22 is rotated by a power for driving the water pump 1.

The bearing 20 is disposed in the water pump housing 10. In addition, the bearing 20 is adapted to smoothly rotate the water pump drive shaft 22 such that the water pump 1 easily pumps coolant. In other words, the water pump drive shaft 22 is disposed to penetrate the bearing 20 and to roll-contact power transmission members in the bearing 20.

The first rotation plate 24 is mounted on one end of the water pump drive shaft 22. In addition, the first rotation plate 24 rotates with the water pump drive shaft 22. Further, the first rotation plate 24 may be formed in a disk shape including two circular surfaces.

The impeller rotation shaft 32 is disposed on the same axis as the water pump drive shaft 22 and is a fixed element. In addition, the impeller rotation shaft 32 is independently provided with the water pump drive shaft 22.

The impeller bearing 34 is adapted to rotatably enclose an exterior circumference of the impeller rotation shaft 32.

The second rotation plate 36 is mounted on one end of the impeller bearing 34. In addition, the second rotation plate 36 rotates with the impeller bearing 34. Further, the second rotation plate 36 may be formed in a disk shape including two circular surfaces.

The impeller 30 is mounted on the other end of the impeller bearing 34. In addition, the impeller 30 rotates with the impeller bearing 34. Meanwhile, the function and shape of the impeller 30 disposed in the water pump 1 is well-known to a person of ordinary skill in the art, so a detailed description thereof will be omitted.

The first magnet 40 is mounted on one surface of the first rotation plate 24. In addition, the first magnet 40 rotates with the first rotation plate 24. Further, the first magnet 40 is integrally or radially formed along the circumference of the first rotation plate 24. The shape of the first magnet 40 can be changed by a person of ordinary skill in the art.

The second magnet 42 is mounted on one surface of the second rotation plate 36. The second magnet 42 rotates with the first rotation plate 24. Further, the second magnet 42 is formed in a shape corresponding to the first magnet 40.

The one surface of the first rotation plate 24 and the one surface of the second rotation plate 36 are disposed apart by a predetermined distance from each other and face each other. In addition, the first magnet 40 and the second magnet 42 are disposed apart by a predetermined distance from each other between the first rotation plate 24 and the second rotation plate 36. Further, facing poles of the first and second magnets 40 and 42 are different from each other.

Therefore, the second magnet 42 and the second rotation plate 36 are integrally rotated by magnetic force of the first and second magnets 40 and 42 when the first rotation plate 24 and the first magnet 40 are integrally rotated. Magnetic slip is generated by resistance of coolant so as to constantly maintain the rotation speed of the impeller 30 when a vehicle is operated at a high speed since torque of the water pump drive shaft 22 is transmitted to the impeller 30 by the magnetic force. Herein, the magnetic slip means that the rotation speeds of the first and second magnets 40 and 42 are different each other since the second magnet 42 rotates, and at the same time, is slid on the first magnet 40 in a case that the rotation speed of the first magnet 40 is excessively fast.

Meanwhile, the water pump drive shaft 22 and the first rotation plate 24 may be integrally formed with each other, and the impeller bearing 34 and the second rotation plate 36 may be integrally formed with each other.

The impeller case 50 forms a space therein in which the impeller rotation shaft 32, the impeller bearing 34, the second rotation plate 36, the second magnet 42 and the impeller 30 are disposed. In addition, the impeller case 50 is formed by coupling two pieces, and at least one of the two pieces is bent so as to form the space. Meanwhile, the impeller rotation shaft 32 is fixedly connected to the impeller case 50. Further, the impeller case 50 may be fixedly connected to the water pump housing 10.

The O-ring 52 is disposed between the two pieces of the impeller case 50. In other words, the O-ring 52 is mounted at the surface where the two pieces are coupled with each other. The O-ring 52 is a ring that is formed in a shape of an 'O' and is made of a rubber material. In addition, the O-ring 52 is used so as to seal components for preventing leakage of a fluid like a gas or a liquid. This O-ring 52 is well-known to a person of ordinary skill in the art, so a detailed description thereof will be omitted.

The dust cover 54 is disposed near the second magnet 42 so as to prevent foreign materials flowing from the coolant into the second magnet 42. In addition, one end of the dust cover 54 is fixedly connected to the impeller case 50 and the other end of the dust cover 54 extends so as to enclose the second rotation plate 36 and the second magnet 42.

A distal end of the impeller 30 is aligned toward the dust cover 54 to prevent foreign material from entering into the second magnet 42.

Meanwhile, the shape of the dust cover 54 can be changed by a person of ordinary skill in the art so as to prevent foreign materials of the coolant flowing into the components.

As described, according to an exemplary embodiment of the present invention, coolant flowing into the bearing 20 can be prevented since the bearing 20 and the impeller 30 are separated from each other. In addition, the manufacturing cost of the water pump 1 can be decreased by deleting a sealing member disposed between the bearing 20 and the impeller 30.

In addition, the rotation speed of the impeller 30 can be constantly maintained since the torque of the water pump drive shaft 22 is transmitted to the impeller 30 by the magnetic force. Thus, the cavitation can be prevented so as to reduce noise and vibration. Further, replacing the water pump 1 is possible without draining the coolant, and maintenance of the water pump 1 can be easy.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A water pump for a vehicle comprising:

a water pump housing forming an outer wall of the water pump;

a water pump drive shaft mounted in the water pump housing and rotated by power of driving the water pump;

a bearing mounted in the water pump housing and rotatably supporting the water pump drive shaft to slidably rotate the water pump drive shaft in the water pump;

a first rotation plate connected to one end of the water pump drive shaft and rotating with the water pump drive shaft;

a first magnet mounted on one surface of the first rotation plate;

an impeller rotation shaft coaxially disposed with the water pump drive shaft;

an impeller bearing rotatably enclosing an exterior circumference of the impeller rotation shaft;

a second rotation plate connected to one end of the impeller bearing so as to rotate with the impeller bearing;

a second magnet mounted on one surface of the second rotation plate; and an impeller connected to the other end of the impeller bearing so as to rotate with the impeller bearing, wherein the one surface of the first rotation plate and the one surface of the second rotation plate are disposed apart from and face each other, and the first magnet and the second magnet are disposed apart from each other such that facing poles of the first and second magnets are different from each other, wherein a dust cover is disposed near the second magnet between the second magnet and the impeller so as to prevent foreign material from flowing into the second magnet, and wherein one end of the dust cover is fixedly connected to an impeller case and the other end of the dust cover extends so as to enclose the second rotation plate and the second magnet, and wherein a portion of the impeller case is disposed between the first magnet and the second magnet and the impeller rotation shaft is fixed to the portion of the impeller case.

2. The water pump of claim 1, wherein the second rotation plate is rotated by magnetic force of the first magnet and the second magnet when the first rotation plate is rotated.

3. The water pump of claim 1, further including the impeller case forming a space therein in which the impeller rotation shaft, the impeller bearing, the second rotation plate, the second magnet and the impeller are disposed.

4. The water pump of claim 3, wherein the impeller case is formed by coupling two pieces, and at least one of the two pieces is bent so as to form the space.

5. The water pump of claim 4, wherein an O-ring is disposed between the two pieces.

6. The water pump of claim 4, wherein a distal end of the impeller is aligned toward the dust cover to prevent foreign material from entering into the second magnet.

7. The water pump of claim 4, wherein the one of the two pieces of the impeller case is fixedly connected to the water pump housing.

8. The water pump of claim 1, wherein a distal end of the impeller is aligned toward the dust cover to prevent foreign material from entering into the second magnet.

9. The water pump of claim 3, wherein the impeller case is fixedly connected to the water pump housing.

* * * * *